US010309216B2

(12) United States Patent
Tueckmantel et al.

(10) Patent No.: US 10,309,216 B2
(45) Date of Patent: Jun. 4, 2019

(54) METHOD OF UPSCALING A DISCRETE FRACTURE NETWORK MODEL

(71) Applicant: SHELL OIL COMPANY, Houston, TX (US)

(72) Inventors: Christian Tueckmantel, Rijswijk (NL); Bastiaan Antonius Hermanus Huisman, Rijswijk (NL)

(73) Assignee: SHELL OIL COMPANY, Houston, TX (US)

( * ) Notice: Subject to any disclaimer, the term of this patent is extended or adjusted under 35 U.S.C. 154(b) by 611 days.

(21) Appl. No.: 14/931,536

(22) Filed: Nov. 3, 2015

(65) Prior Publication Data

US 2016/0123119 A1 May 5, 2016

Related U.S. Application Data

(60) Provisional application No. 62/074,999, filed on Nov. 4, 2014.

(51) Int. Cl.

| | |
|---|---|
| ***E21B 43/26*** | (2006.01) |
| ***E21B 47/00*** | (2012.01) |
| ***E21B 49/00*** | (2006.01) |
| ***E21B 43/12*** | (2006.01) |

(52) U.S. Cl.
CPC ..... *E21B 49/00* (2013.01); *E21B 43/126* (2013.01); *E21B 47/00* (2013.01)

(58) Field of Classification Search
CPC ..... E21B 49/00; E21B 43/26–43/267; E21B 47/00–47/187
See application file for complete search history.

(56) References Cited

U.S. PATENT DOCUMENTS

2009/0065253 A1* 3/2009 Suarez-Rivera ..... E21B 43/17 175/50

OTHER PUBLICATIONS

Elfeel, Ahmed, et al.: Static and Dynamic Assessment of DFN Permeability Upscaling. SPE 154369, pp. 1-16, 2012.
Elfeel, Ahmed, et al.: Effect of DFN Upscaling on History Matching and Prediction of Naturally Fractured Reservoirs, SPE 164838, pp. 1-14, 2013.

(Continued)

*Primary Examiner* — Amar Movva

(57) ABSTRACT

A discrete fracture network model is upscaled to a simulation grid having effective permeabilities for each grid cell. Prior to computing the effective permeabilities, the grid cells are grouped in distinct grid cell clusters, such that flow via fractures is only possible between grid cells that mutually belong to the same grid cell cluster. This is achieved by grouping fractures into distinctive fracture clusters, whereby all fractures that are physically connected with each other by intersection, either directly or indirectly via a number of other physically connected fractures, exclusively belong to one fracture cluster. Each grid cell is assigned to exclusively one fracture cluster. After defining the grid cell clusters, effective permeabilities are calculated for each grid cell using only the fractures of the fracture cluster to which the grid cell is assigned while fractures from other fracture clusters are ignored. Inter-cluster flow impediment data is assigned to selected grid cells.

12 Claims, 6 Drawing Sheets

(56) References Cited

OTHER PUBLICATIONS

Correia, Manuel G., et al. Upscaling Technique Applied to Naturally Fractured Carbonate Reservoirs, SPE 143150, pp. 1-12, 2011.
Correia, Manuel G., et al.: A Procedure for Upscaling a Complex Fractured Reservoir using Near-Well Refinement, SPE 153558, pp. 1-10, 2012.
Decroux, Benoit, et al.: Computation of Effective Dynamic Properties of Naturally Fractured Reservoirs: Comparison and Validation of Methods. SPE 164846, pp. 1-18, 2013.
Ding, Y. et al.: Upscaling Fracture Networks for Simulation of Horizontal Wells Using a Dual-Porosity Reservoir Simulator.,SPE Reservoir Simulation Symposium, pp. 513-520, 2006.
Shewchuk, Jonathan R.: "What Is a Good Linear Element? Interpolation, Conditioning, and Quality Measures,." Eleventh International Meshing Roundtable. Ithaca, New York: Sandia National Laboratories, 2002. pp. 115-126.
Hui, Mun-Hong, et al: The Upscaling of Discrete Fracture Models for Faster, Coarse-Scale Simulations of IOR and EOR Processes for Fractured Reservoirs. SPE 166075, pp. 1-16, 2013.
Matthai, Stephan K., et al.: Upscaling two-phase flow in naturally fractured reservoirs. AAPG Bulletin, 93, pp. 1621-1632, 2009.
Panfili, P., et al.: Advanced Upscaling for Kashagan Reservoir Modeling. SPE Reservoir Eval. & Eng., SPE 146508, pp. 150-164, 2012.
Salimi, H., et al.:Upscaling in Partially Fractured Oil Reservoirs Using Homogenization. SPE/EAGE Reservoir Characterization and Simulation Conference. SPE 125559, pp. 1-26, 2009.
Tillerson, J.R., et al.: Rock Mechanics Proceedings of the 33rd U.S. Symposium, Sweeney Convention Center, Santa Fe, NM, pp. 1-11, Jun. 1992.
Bourbiaux, B., et al.: "A Fast and Efficient Methodology to Convert Fractured Reservoir Images into Dual Porosity Model." SPE 38907, pp. 1-12, 1997.
Cacas, M.C., et al.: "Modeling Fracture Flow with a Stochastic Discrete Fracture Network: Calibration and Validation: The Flow Model." Water Resources Research, vol. 26, No. 3, pp. 479-489, Mar. 1990.
Cacas, M.C., et al.: "Nested geological modelling of naturally fractured reservoirs." Petroleum Geoscience, vol. 7 pp. S43-S52, 2001.
Dershowitz, William S., et al: "Integration of Discrete Feature Network Methods With Conventional Simulator Approaches." SPE Reservoir Eval. & Eng., 3, No. 2, pp. 165-170, Apr. 2000.
Dershowitz, William, et al: "Integration of Discrete feature network methods with Conventional Simulator Approaches", SPE 49069, pp. 1-9, 1998.
Dershowitz, William, et al.: "Discrete Feature Dual Porosity Analysis of Fractured Rock Masses. Applications to Fractured Reservoirs and Hazardous Waste.", Rock Mechanics, 1992.
Durlofsky, Louis J.: "Numerical Calculation of Equivalent Grid Block Permeability Tensors for Heterogeneous Porous Media." Water Resources Research, vol. 27, No. 5, pp. 699-708, May 1991.
Durlofsky, Louis .J.: "Upscaling and Gridding of Fine Scale Geological Models for Flow Simulation." 8th International Forum on Reservoir Simulation, Iles Borromees, Stresa, Italy, pp. 1-59, Jun. 2005.
Geiger, S., et al. "Massively Parallel Sector Scale Discrete Fracture and Matrix Simulations." SPE 118924, pp. 1-16, 2009.
Geiger, S., et al.: . "Black Oil Simulations for Three-Component-Three Phase Flow in Fractured Porous Media.", SPE 107485, pp. 1-14, 2009.
Vitel, S., et al.: "Unstructured Upgridding and Transmissibility Upscaling of Preferential Flow Paths in 3D Fractured Reservoirs, SPE 106483." SPE Journal, 2007.
Gong, B., et al.: An Upscaling Procedure for Constructing Generalized Dual-Porosity/Dual-Perrmeability Models from Discrete Fracture Characterizations, SPE 102491, pp. 1-14, 2006.
Harris, C.K. :"Application of Generalised Effective Medium Theory to Transport in Porous Media." Transport in Porous Media 5, pp. 517-542, 1990.
Harris, C.K.: "Effective-Medium Treatment of Flow Through Anisotropic Fracture System—Improved Permeability Estimates Using a New Lattice Mapping." Transport in Porous Media 9, pp. 287-295, 1992.
Karimi-Fard, M., et al.: "An efficient Discrete-Fracture Model Applicable for General-Purpose Simulators." SPE Journal 9, No. 2, pp. 227-236, 2004.
Khvoenkova N., et al.: "Performance Analysis of the Hybrid Fracture Media Upscaling Approach on a Realistic Case of Naturally Fractured Reservoir", IPTC 13935, pp. 1-10, Doha, Qatar, 2009.
Snow, David T.: "Anisotropic Permeability of Fractured Media." Water Resources Research, vol. 5, No. 6, pp. 273-1289, Dec. 1969.
Lee, S.H., et al.: An Efficient Finite Difference Model for Flow in a Reservoir with Multiple Length-Scale Fractures, SPE 56752, pp. 1-13, 1999.
Long, Jane C.S., et al.: "A Model for Steady Fluid Flow in Random Three-Dimensional Networks of Disc-Shaped Fractures", Water Resources Research 21, No. 8, pp. 1105-115, Aug. 1985.
Long Jane, C. et al.: "The Relationship of the Degree of Interconnectivity to Permeability in Fracture Networks." J. Geophys. Res. vol. 90, No. B4, pp. 3087-3098, Mar. 1985.
Lough, Michael F., et al.: "New Method to Calculate Effective Permeability of Gridblocks Used in the Simulation of Naturally Fractured Reservoirs." SPE Reservoir Eng, pp. 219-224, 1997.
Lough, M.F., et al.: "An efficient Boundary Integral Formulation for Flow through Fractured Porous Media." Journal of Computational Physics 143, pp. 462-483, 1998.
Makel, H. G. "The modeling of fractured reservoirs: constraints and potential of fracture network geometry and hydraulic analysis." in Structurally complex reservoirs, by S. J. Jolley, 488. London: Geological Society of London, 2007.
The Geological Society of America, Geoscience Horizons: Seattle 2003 , GSA Annual Meeting & Exposition, Session No. 77. pp. 196.
Murphy, Michael, et al.: "A Point placement strategy for confirming Delaunay Tetrahedralization ." Proceedings of the 11th Annual ACM-SIAM symposium on Discrete algorithms, pp. 67-64, 2000.
Mustapha, H. Monte Carlo Simulation of Flow in Three-Dimentional Discrete Fracture Networks, Applied Mathematics Departments University of Maine, pp. 1-9.
Ding, Y. et al.: Upscaling Fracture Networks for Simulation of Horizontal Wells Using a Dual-Porosity Reservoir Simulator, SPE 92774, pp. 1-10, 2005.
Oda, M. "Permeability tensor for discontinuous rock masses." Geotechnique 35, No. 4, pp. 483-495, 1985.
Oda, M., Y. Hatsuyama, and Y. Ohnishi. "Numerical Experiments of Permeability Tensor and its Application to Jointed Granite at Stripa Mine." J. Geophys Res. 92, No. B8, pp. 8037-8048, Jul. 1987.
Warren, J.E,, et al.:. "The Behavior of Naturally Fracture Reservoirs." (SPE Journal) 1963.
Schwartz, L.M, et. al: "Transport Properties of Disordered Continuum Systems." Phys. Rev. B, vol. 39, No. 16, pp. 11965-11970, Jun. 1989.

* cited by examiner

METHOD OF UPSCALING A DISCRETE FRACTURE NETWORK MODEL

This application claims the benefit of U.S. Provisional Application No. 62/074,999 filed Nov. 4, 2014, which is incorporated herein by reference.

FIELD OF THE INVENTION

In one aspect, the present invention relates to a method of upscaling a discrete fracture network model. In another aspect the present invention relates to a computer readable medium having stored on it a set of computer instructions that when loaded in a computer is capable of carrying out steps comprising said method of upscaling a discrete fracture network model. The present invention further relates to a computer system programmed to carry out steps comprising said method of upscaling a discrete fracture network model.

BACKGROUND OF THE INVENTION

Oil and gas are produced from subsurface hydrocarbon bearing reservoir formations. One or more wells may be drilled to connect these subsurface hydrocarbon bearing reservoir formations to the surface allowing oil and gas to be released at the surface. Numerous of these subsurface hydrocarbon bearing reservoir formations are naturally fractured. Fractures can provide a major contribution to the permeability of the reservoir formation rocks to fluids. Considerable time and money is spent in the oil and gas industry to acquire fracture data using for instance borehole images and cores and to build discrete fracture network (DFN) models that are consistent with the data. In order to use the DFN models for dynamic flow simulations, it is known in the art to translate the DFN model to a grid-based set of effective permeability properties. This is known in the art as "upscaling".

SPE paper 154369 "Static and Dynamic Assessment of DFN Permeability Upscaling" by M. Ahmed Elfeel and S. Geiger describes two main upscaling methods used in the industry: Oda's method and a flow-based method. Oda's method uses an analytical expression of an effective permeability tensor by adding weighted fracture permeabilities regardless of whether the fractures within the grid cell percolate. Hence, Oda's method is known to over-estimate permeabilities, particularly in poorly connected fracture networks. Flow-based methods calculate permeability of each grid cell by computational flow simulations on each grid cell based on the fractures that are present in the grid cell. This is computationally extensive and the end result has been found to be sensitive to orientation and size of the grid cells compared to the DFN model.

SUMMARY OF THE INVENTION

In accordance with a first aspect of the present invention, there is provided a method of upscaling a discrete fracture network model, comprising:

providing a discrete fracture network model of a subsurface fractured hydrocarbon bearing reservoir formation, said discrete fracture network model comprising a plurality of fractures;

grouping all fractures of the plurality of fractures into fracture clusters, whereby all fractures that are physically connected with each other by intersection, either directly or indirectly via a number of other physically connected fractures, exclusively belong to one fracture cluster such that no fracture within one fracture cluster is physically connected with any fracture of any of the other fracture clusters;

assigning a unique fracture cluster number to each of the fracture clusters;

overlaying a three dimensional simulation grid over the discrete fracture network model, consisting of a three dimensional array of grid cells in three directions;

attributing a grid cell cluster number to each grid cell in the simulation grid, which grid cell cluster number uniquely maps to the unique fracture cluster number of exclusively one fracture cluster that intersects with the grid cell;

computing an effective permeability for each grid cell and for each of the three directions using the fractures that are inside the grid cell and that form part of the fracture cluster that has the fracture cluster number to which the grid cell cluster number of the grid cell is uniquely mapped, whereby ignoring other fractures that are inside the grid cell but that form part of a fracture cluster having a fracture cluster number that does not map to the grid cell cluster number of the grid cell; and assigning inter-cluster flow impediment data to selected grid cells reflecting flow impediment bathers between neighboring grid cell clusters;

outputting a table containing grid property data for all grid cells, wherein the grid property data for each grid cell comprises the cluster number assigned to the grid cell, and one effective permeability number for each of the three directions; and outputting inter-cluster flow impediment data.

In accordance with a second aspect of the invention, there is provided a computer readable medium having stored on it a set of computer instructions that when loaded in a computer is capable of carrying out steps comprising:

receiving a discrete fracture network model of a subsurface fractured hydrocarbon bearing reservoir formation, said discrete fracture network model comprising a plurality of fractures as input;

grouping all fractures of the plurality of fractures into fracture clusters, whereby all fractures that are physically connected with each other by intersection, either directly or indirectly via a number of other physically connected fractures, exclusively belong to one fracture cluster such that no fracture within one fracture cluster is physically connected with any fracture of any of the other fracture clusters;

assigning a unique fracture cluster number to each of the fracture clusters;

overlaying a three dimensional simulation grid over the discrete fracture network model, consisting of a three dimensional array of grid cells in three directions;

attributing a grid cell cluster number to each grid cell in the simulation grid, which grid cell cluster number uniquely maps to the unique fracture cluster number of exclusively one fracture cluster that intersects with the grid cell;

computing an effective permeability for each grid cell and for each of the three directions using the fractures that are inside the grid cell and that form part of the fracture cluster that has the fracture cluster number to which the grid cell cluster number of the grid cell is uniquely mapped, whereby ignoring other fractures that are inside the grid cell but that form part of a fracture cluster having a fracture cluster number that does not map to the grid cell cluster number of the grid cell; and assigning inter-cluster flow impediment data to selected grid cells reflecting flow impediment bathers between neighboring grid cell clusters;

outputting a table containing grid property data for all grid cells, wherein the grid property data for each grid cell comprises the cluster number assigned to the grid cell, and one effective permeability number for each of the three directions; and outputting inter-cluster flow impediment data.

In accordance with a third aspect of the invention, there is provided a computer system programmed to carry out steps comprising:

receiving a discrete fracture network model of a subsurface fractured hydrocarbon bearing reservoir formation, said discrete fracture network model comprising a plurality of fractures as input;

grouping all fractures of the plurality of fractures into fracture clusters, whereby all fractures that are physically connected with each other by intersection, either directly or indirectly via a number of other physically connected fractures, exclusively belong to one fracture cluster such that no fracture within one fracture cluster is physically connected with any fracture of any of the other fracture clusters;

assigning a unique fracture cluster number to each of the fracture clusters;

overlaying a three dimensional simulation grid over the discrete fracture network model, consisting of a three dimensional array of grid cells in three directions;

attributing a grid cell cluster number to each grid cell in the simulation grid, which grid cell cluster number uniquely maps to the unique fracture cluster number of exclusively one fracture cluster that intersects with the grid cell;

computing an effective permeability for each grid cell and for each of the three directions using the fractures that are inside the grid cell and that form part of the fracture cluster that has the fracture cluster number to which the grid cell cluster number of the grid cell is uniquely mapped, whereby ignoring other fractures that are inside the grid cell but that form part of a fracture cluster having a fracture cluster number that does not map to the grid cell cluster number of the grid cell; and assigning inter-cluster flow impediment data to selected grid cells reflecting flow impediment bathers between neighboring grid cell clusters;

outputting a table containing grid property data for all grid cells, wherein the grid property data for each grid cell comprises the cluster number assigned to the grid cell, and one effective permeability number for each of the three directions; and outputting inter-cluster flow impediment data.

DETAILED DESCRIPTION OF THE INVENTION

Figure 1:
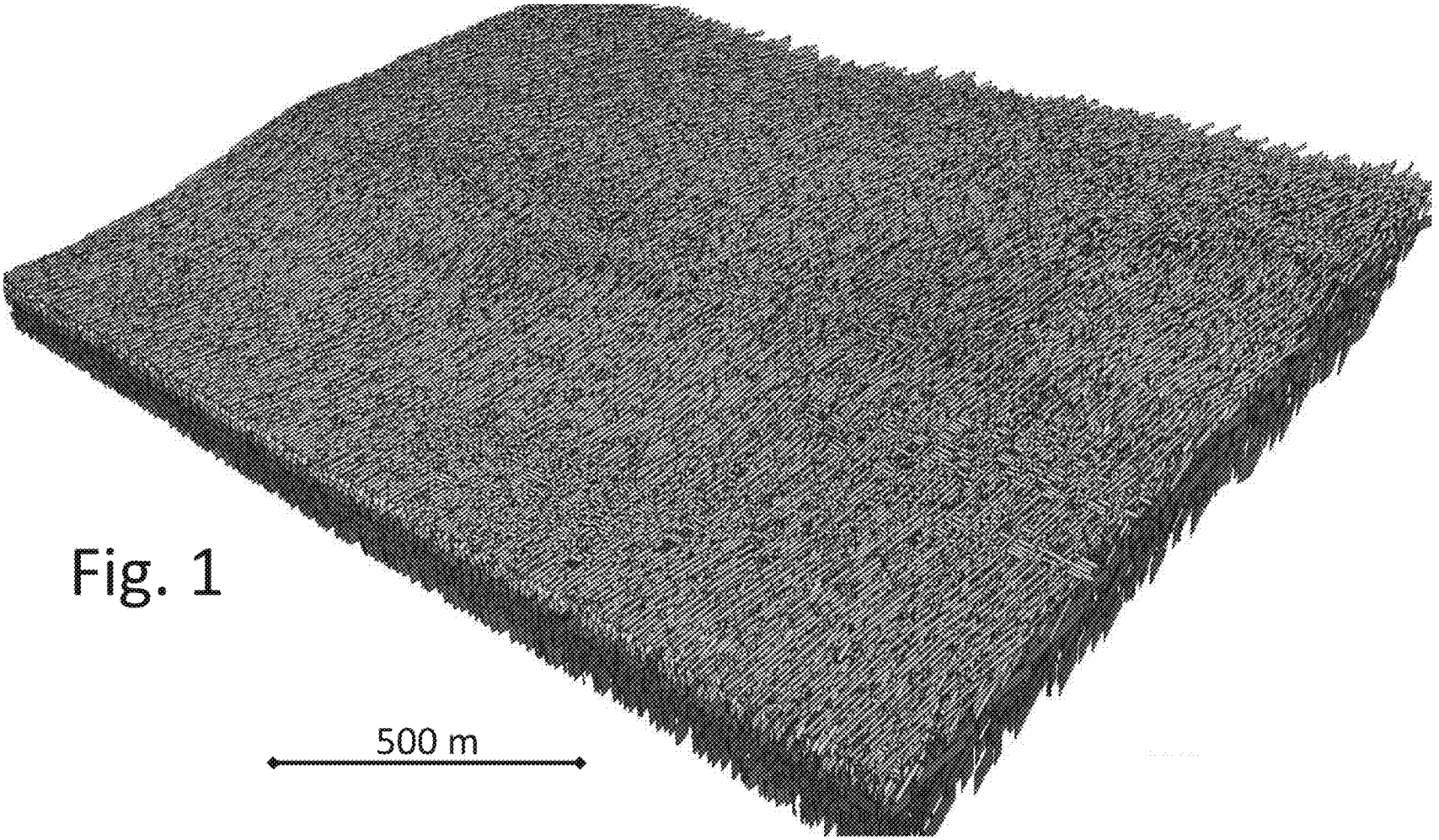
FIG. 1 schematically shows a DFN model.

The invention will be further illustrated hereinafter by way of example only, and with reference to the non-limiting drawing.

For the purpose of this description, identical reference numbers used in different figures refer to similar components. The person skilled in the art will readily understand that, while the invention is illustrated making reference to one or more a specific combinations of features and measures, many of those features and measures are functionally independent from other features and measures such that they can be equally or similarly applied independently in other embodiments or combinations.

A novel upscaling method is presently proposed, wherein prior to computing effective permeabilities for each grid cell, the grid cells are grouped in distinct grid cell clusters, such that fluid flow is only possible between grid cells that mutually belong to the same grid cell cluster. This is achieved by grouping all fractures in the DFN into distinctive fracture clusters, whereby all fractures that are physically connected with each other by intersection, either directly or indirectly via a number of other physically connected fractures, exclusively belong to one fracture cluster such that no fracture within one fracture cluster is physically connected with any fracture of any of the other fracture clusters. Each grid cell is assigned to exclusively one fracture cluster. After defining the grid cell clusters, effective permeabilities are calculated for each grid cell using only the fractures that form part of the fracture cluster to which the grid cell is assigned while fractures from other fracture clusters are ignored. Inter-cluster flow impediment data is assigned to selected grid cells reflecting flow impediment bathers between neighboring grid cell clusters.

Thus, in the proposed method, known existing upscaling methods are combined with an independent fracture cluster analysis. Only after grouping grid cells in accordance with identified fracture clusters the effective permeabilities are computed under a condition that flow is only possible between grid cells that belong to the same grid cell cluster. An advantage of this method of upscaling is that internal connectivity of the fracture network on a field scale is preserved in the upscaled simulation grid. This is a clear improvement over existing upscaling methods, and it provides the reservoir engineer with a much more reliable simulation grid that better reflects the fracture connectivity of the DFN model. In a simulation grid upscaled by Oda's method flow can occur between all neighboring grid cells within the simulation grid that contain fractures whose orientation is at least partly parallel to the considered flow direction. Hence, Oda's method does not recognize fracture clusters correctly. In a simulation grid upscaled by the flow-based method some grid cell clustering can occur, but it is not based on or even correlated to fracture clusters and thus it does not reflect the correct connectivity in the field. Simulation grids that do not correctly reflect connectivity in the field may lead to misleading flow simulation results and consequently development decisions based on misleading flow simulation results may be suboptimal.

The steps of the novel upscaling method are suitably carried out on a suitably programmed computer system. A set of computer readable instructions may be stored on a computer readable medium such that when the set of computer readable instructions is loaded in a computer the computer is caused to carry out the steps of the novel upscaling method. In one group of embodiments, the computer readable medium is a non-transitory computer readable medium.

The output from the method of the invention is a table containing grid property data for all grid cells in the simulation grid and the inter-cluster flow impediment data. The grid property data for each grid cell comprises at least a cluster number assigned to the grid cell, and one effective permeability number for each of the three directions. The output may be directed to an output device. Examples of output devices include a screen, a monitor, a printer. In some embodiments the output of the method of upscaling is used as input for other methods. In such cases it is useful if the output device comprises a computer readable medium.

Ultimately, results of dynamic simulations using simulation grids that have been generated using the presently proposed method of upscaling a DFN model may be used to guide field development decisions on how to best develop the subsurface fractured hydrocarbon bearing reservoir formation. Thus the table containing the grid property data for all grid cells and the inter-cluster flow impediment data may ultimately be used to create a field development plan. The field development plan may include, but is not limited to, planning the position and type of wells to be drilled, and decisions on production rates from or injection rates into the subsurface fractured hydrocarbon bearing reservoir formation via existing or planned wells. The field development plan may subsequently be executed by employing a well that connects into the subsurface fractured hydrocarbon bearing reservoir formation. For example, the well may subsequently be drilled and/or the production and/or injections rates via existing and/or newly drilled wells may be implemented in accordance with the field development plan.

The method of upscaling a discrete fracture network starts with providing a discrete fracture network (DFN) model of a subsurface fractured hydrocarbon bearing reservoir formation. A graphical example of such a DFN is shown in FIG. 1. A typical DFN model may represent a fractured hydrocarbon bearing reservoir formation. Different sets of fractures are shown in FIG. 1 (each in a different grey tone), which are defined by having a particular orientation and by being located in a particular rock layer of the reservoir formation.

A DFN model can vary widely in dimensions depending on the objective of the model. For instance, a small scale DFN around a well may measure from between 10 m and 100 m by between 10 and 100 m laterally, and between 10 and 100 m thickness. A large scale DFN encompassing all of a subsurface fractured hydrocarbon reservoir formation may measure between 10 and 100 km by between 10 and 100 km laterally, and between 0.1 and 1 km thickness. For the purpose of the presently proposed upscaling method, the DFN model may be a full model or a sector of a full large scale model, for instance measuring between 1 and 10 km by between 1 and 10 km laterally, and between 0.1 and 0.9 km thickness.

According to the available fracture data taken in the field, a large number of fractures, in this case predominantly in the form of vertically oriented fracture planes, is present in this particular hydrocarbon bearing reservoir formation. The DFN model comprises a plurality of fractures, based on the field data such that the DFN model is consistent with the available field data.

Field data can be obtained using a variety of techniques. Examples include borehole images and cores obtained by drilling from the surface into the hydrocarbon bearing reservoir formation. These are the most direct forms of fracture data. Less direct techniques may be used as well, including seismic surveys. In some cases geomechanical modelling is employed to constrain the DFN model. The DFN model should be a realization that is consistent with the fracture-data based evidence that is available.

According to the present method, all fractures of the plurality of fractures in the DFN model are grouped into fracture clusters. A preferred way of grouping fractures into fracture clusters is one whereby all fractures that are physically connected with each other by intersection, either directly or indirectly via a number of other physically connected fractures, exclusively belong to one fracture cluster. However, other criteria are possible. For the purpose of the upscaling method described herein, any single fracture that is not in contact with any other fracture is also considered as a fracture cluster. No fracture within one fracture cluster is physically connected with any fracture of any of the other fracture clusters.

Figure 2:
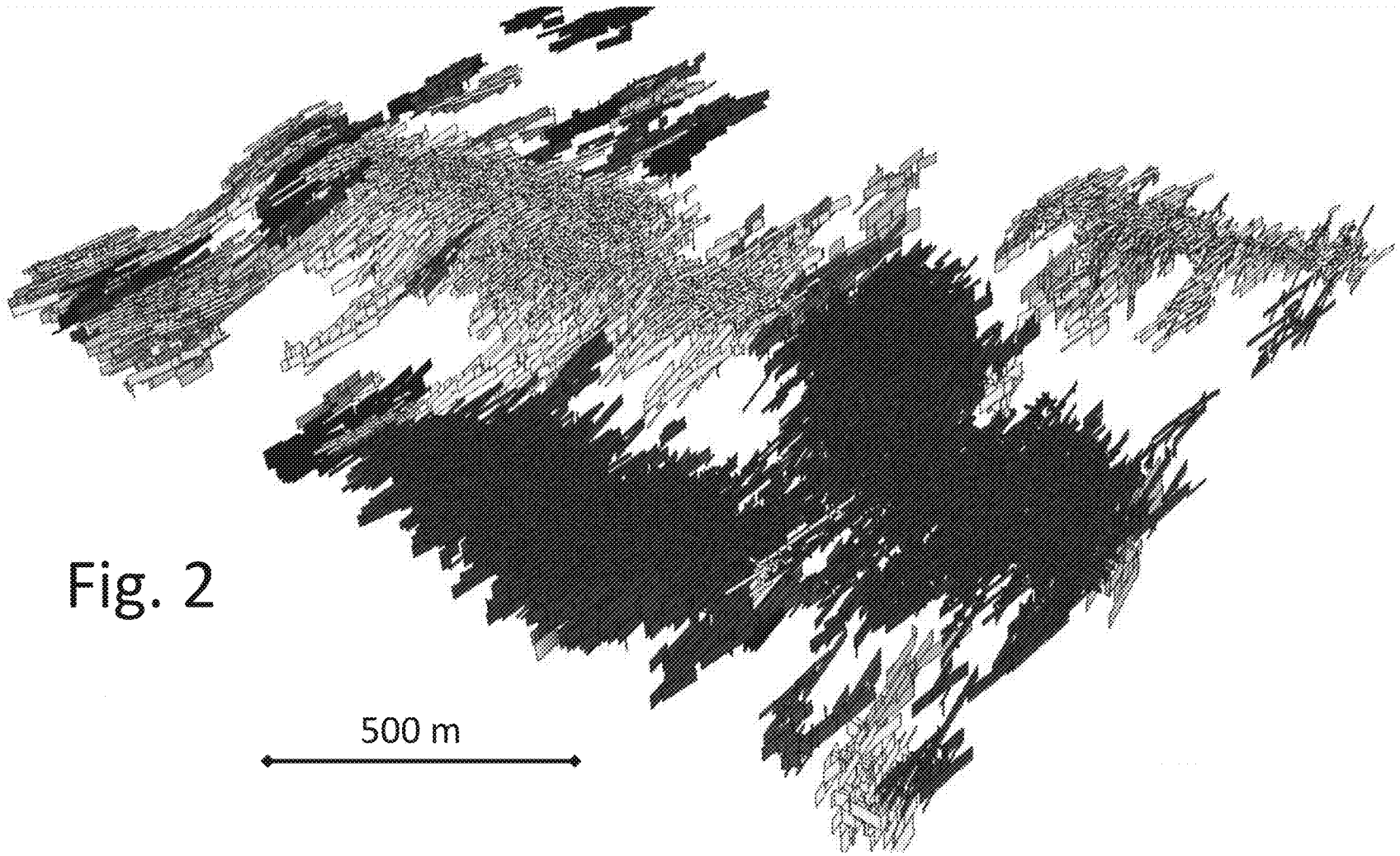
FIG. 2 schematically shows a selection of fractures from the DFN model of FIG. 1 that belong to clusters of more than 20 fractures.

FIG. 2 contains a graphical view of fracture clusters that are present in the DFN model of FIG. 1. A unique fracture cluster number has been assigned to each of the fracture clusters found in the DFN model. As used herein, the term "number" is not limited to natural numbers or other mathematical numbers—any unique identifier can suffice. Preferably the identifiers have some ordering sequence, so natural numbers are particularly suitable. In the example of FIG. 2 the fracture numbers are represented in grey tones. Fracture clusters containing 20 or fewer fractures have been left out of FIG. 2 in order to gain a better view on the larger fracture clusters.

The essence of connected fractures is that fluids can flow between connected fractures without having to flow though the surrounding rock. Thus within a fracture cluster fluids can flow through intersecting fractures (intra-cluster flow). However, fractures from one fracture cluster do not intersect with fractures of another fracture cluster. For fluid flow to occur between distinct fracture clusters (inter-cluster flow) a non-fracture flow medium is necessary (such as through rock pores) which is generally less permeable than fluid flow through fractures.

The next step in the upscaling method is overlaying a three dimensional simulation grid over the discrete fracture network model. The three dimensional simulation grid consists of a three dimensional array of grid cells in three directions. A typical simulation grid may have thousands up to millions of grid cells depending on the average size of the grid cells and the size of hydrocarbon bearing reservoir underlying the DFN model. The grid cells do not have to be square cubes. For instance, a DFN model (which can be a sector of a large scale model) describing a volume of (x times y times z, wherein z is the vertical (depth) direction) 3.2 km times 2.3 km times 0.2 km may suitably represented by 9 layers of grid cells having an average cell size of for instance 70 m times 50 m times 20 m. These numbers are provided as example and are not intended to limit the scope of the invention.

The grid cells are divided into distinct groups that will be referred to as grid cell clusters, such that fluid flow via fractures is only possible between grid cells that mutually belong to the same grid cell cluster. This is accomplished by attributing a grid cell cluster number to each grid cell in the simulation grid, such that the grid cell cluster number uniquely maps onto one unique fracture cluster number of exclusively one fracture cluster that intersects with the grid cell. If a specific grid cell is intersected by more than one fracture cluster, then that grid cell should be assigned to the grid cell cluster belonging to one of the fracture clusters by assigning the correspondingly mapping grid cell cluster number. The end result is that one grid cell cluster number has been assigned to each grid cell and that a unique one-on-one mapping exists between grid cell cluster number and fracture cluster number, and vice versa.

Suitably, the grid cell is given the grid cell cluster number that maps to the fracture cluster which interests the larger number of (other) grid cells. This does not necessarily coincide with the fracture cluster that has the highest number of fractures in it. Put differently, when more than one fracture cluster intersect with the grid cell, the grid cell cluster number attributed to that grid cell is assigned to map to the unique fracture cluster number of one of the fracture clusters that intersects with the grid cell and that intersects with the highest number of other grid cells compared to how many other grid cells intersect with the other fracture clusters that intersect the grid cell. However, other definitions are possible, such as assigning the grid cell to the grid cell cluster whose fractures make up the largest fracture volume of the total grid cell fracture volume.

Figure 3:
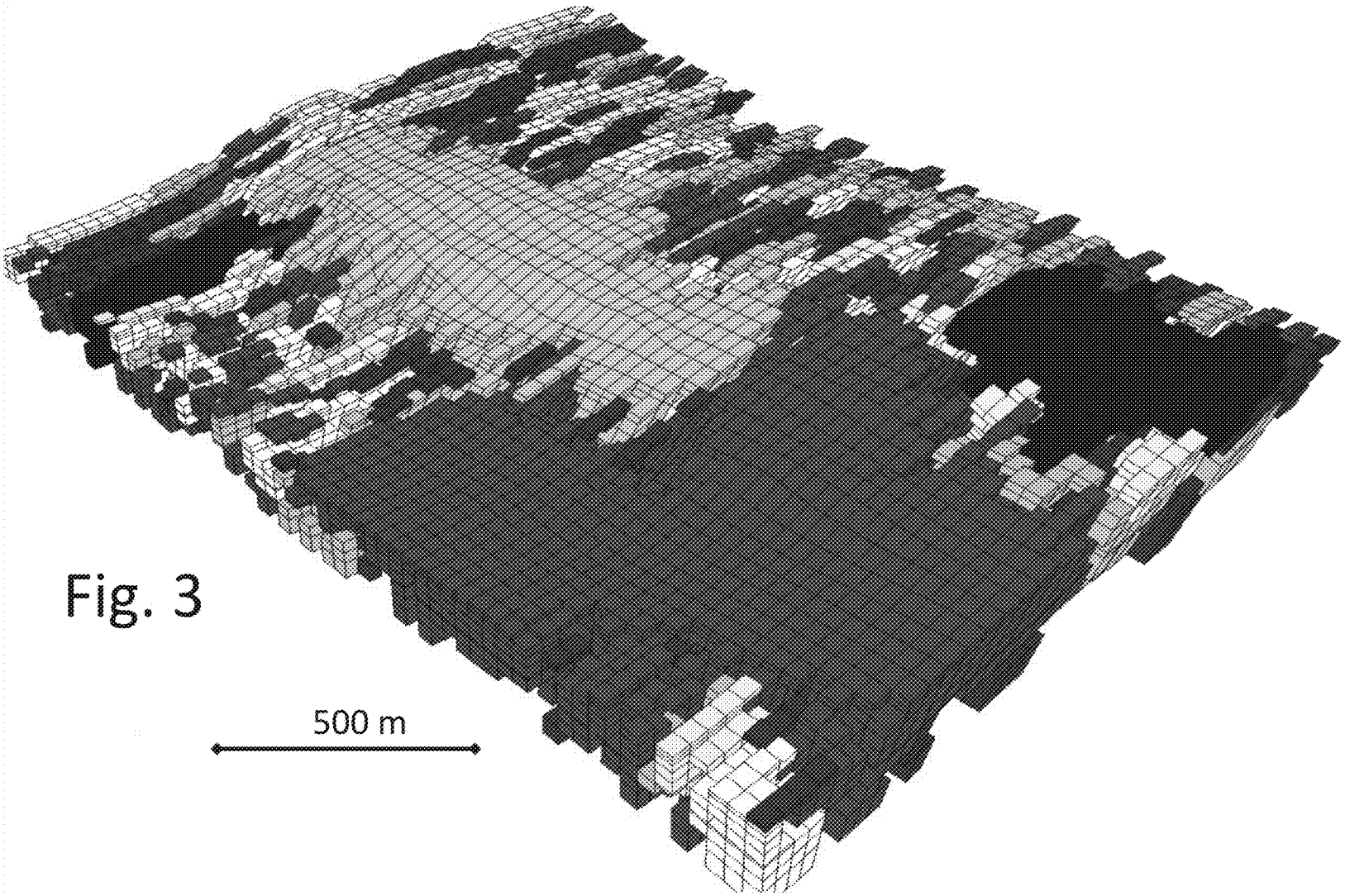
FIG. 3 schematically shows a three dimensional simulation grid overlaid over the DFN model of FIG. 1.

FIG. 3 shows a graphic representation of how the grid cells that overlay the DFN model of FIG. 1 are grouped into distinct grid cell clusters. In the representation of FIG. 3, each grid cell cluster is identified by a different gray tone.

Once the grid cell clusters have been defined, an effective permeability is computed for each grid cell. One permeability number is computed for each of the three directions. This may be done using any suitable known method, preferably Oda's method, subject to that only the fractures are taken into account that are inside the grid cell and that form part of the fracture cluster that determines to which grid cell cluster the grid cell belongs. Other fractures inside the grid cell, which do not form part of that fracture cluster, are ignored for the purpose of computing the effective permeabilities. In addition, inter-cluster flow impediment data are assigned to selected grid cells reflecting flow impediment barriers between neighboring grid cell clusters. This may be done by imposing a lower effective permeability (lower than the otherwise computed effective permeability based on the fractures in the grid cell) in at least one of the three directions, preferably in all three directions, on grid cells that are adjacent to grid cells that do not have the same grid cell cluster number. Suitably, the lower effective permeability is imposed on the grid cell that separates two neighboring grid cell clusters and that belongs to the grid cell cluster that contains the fewer grid cells of the two neighboring grid cell clusters. This way, the dominant fracture cluster will be modeled more accurately in the simulation grid.

The imposed lower effective permeability may suitably be zero, which corresponds to voiding the grid cell resulting in full flow impediment. If a continuous barrier of voided grid cells is present between two adjacent grid cell clusters, effectively this corresponds to a full flow impediment between the adjacent grid cell clusters. However, other values may be used if desired to represent a flow barrier with a selected barrier permeability. An advantage of doing it this way is that the simulation grid can be used as before by the reservoir engineer without modification of the dynamic simulation methodology.

Alternatively, assigning of inter-cluster flow impediment data may consist of imposing an inter-cell transmissibility barrier between adjacent grid cells that do not have the same grid cell cluster number. While this is more accurate, it does require a different approach by the reservoir engineer to take the additional inter-cell transmissibility boundaries into account in the dynamic flow simulations. Also when working with inter-cell transmissibility boundaries, a zero transmissibility may be employed or a selected non-zero transmissibility that is lower than typical transmissibilities between grid cells within a single grid cell cluster.

Figure 4A:
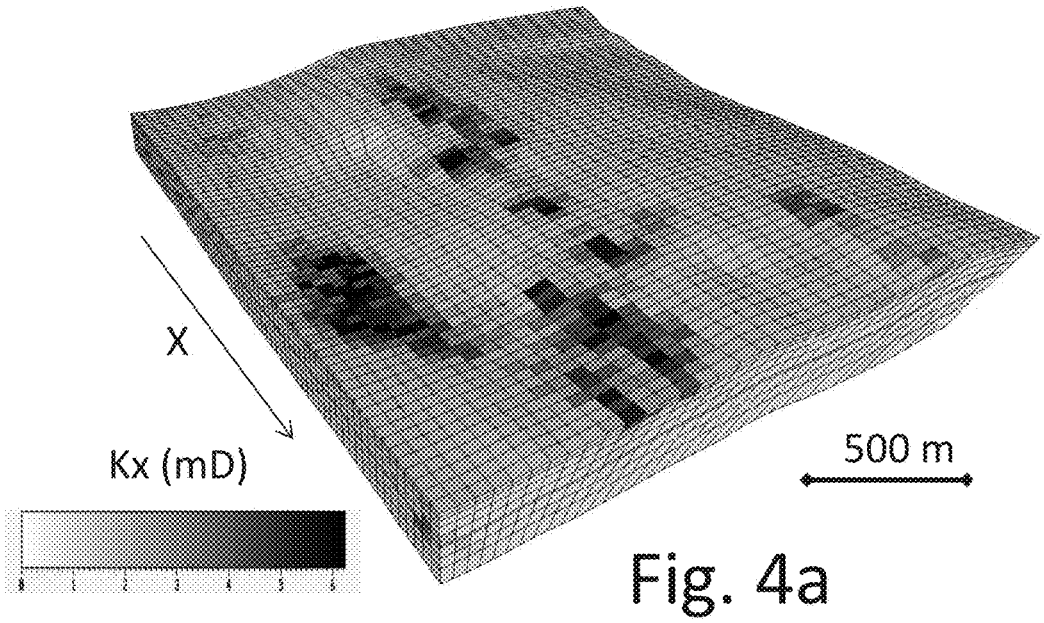
FIG. 4*a* schematically shows effective permeability of grid cells from the three dimensional simulation grid of FIG. 3 in X direction.
Figure 4B:
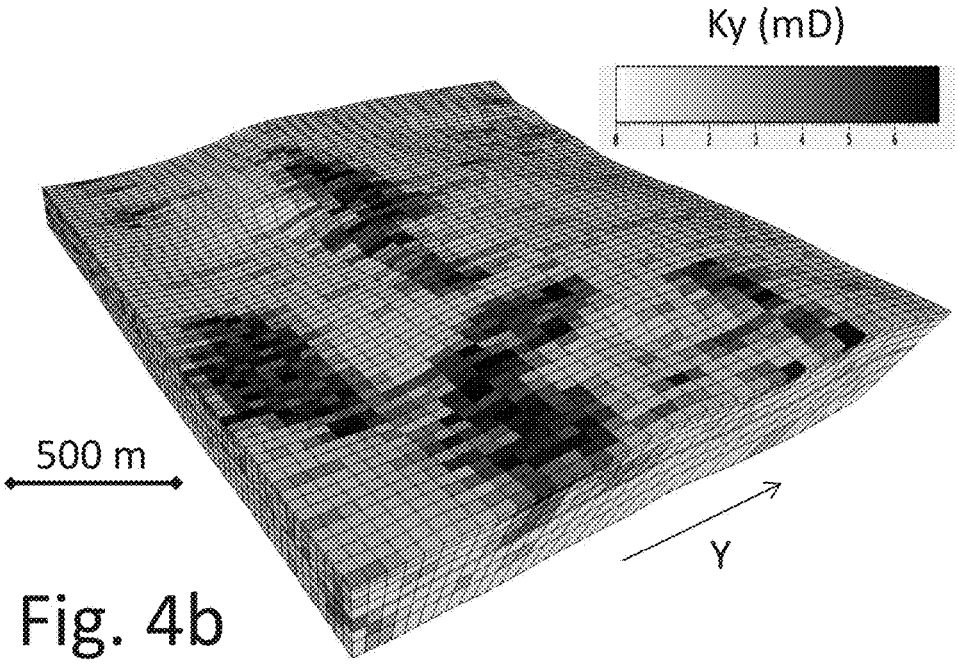
FIG. 4*b* schematically shows effective permeability of grid cells from the three dimensional simulation grid of FIG. 3 in Y direction.
Figure 4C:
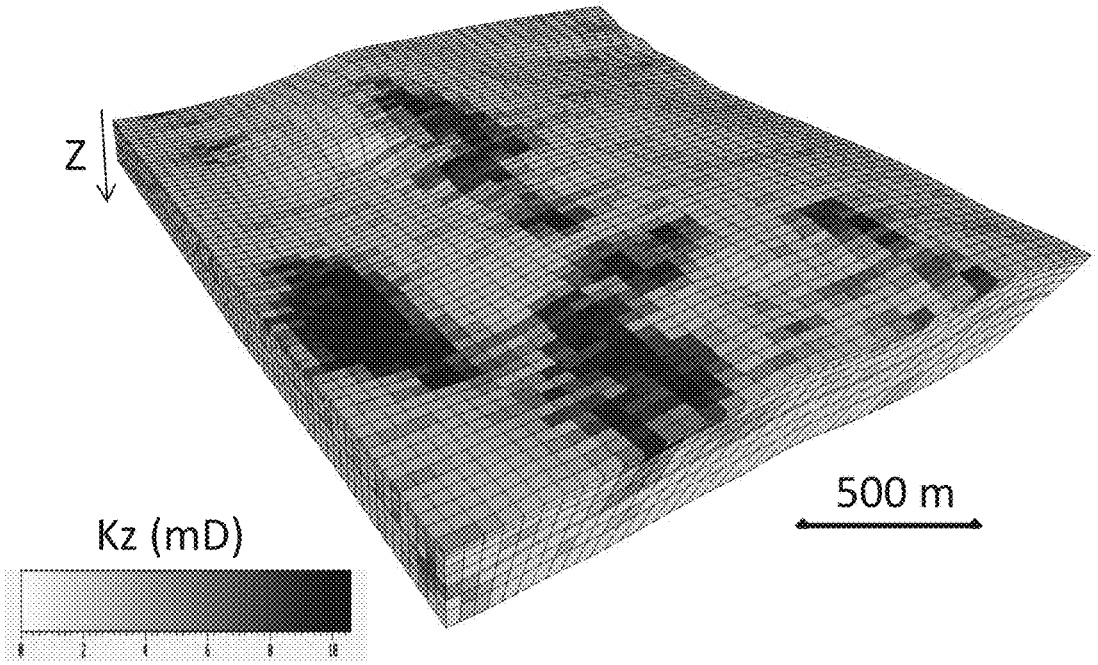
FIG. 4*c* schematically shows effective permeability of grid cells from the three dimensional simulation grid of FIG. 3 in Z direction.

A table containing grid property data for all grid cells is outputted. The grid property data comprises the cluster number assigned to the grid cell, and one effective permeability number for each of the three directions. Graphical examples of parts of the outputted table are shown in FIG. 4, wherein the effective permeability for each grid cell has been computed using an analytical expression of the effective permeability tensor using Oda's method, wherein adding weighted fracture permeabilities in each of the three directions. FIG. 4*a* shows in a linear grey scale representation the calculated effective permeability for each grid cell in the x-direction, whereby white corresponds to 0 and black corresponds to 6.24 mD. Similarly, FIG. 4*b* shows a linear grey scale representation of the calculated effective permeability for each grid cell in the y-direction, whereby white corresponds to 0 and black corresponds to 6.95 mD. FIG. 4*c* shows a linear grey scale representation of the calculated effective permeability for each grid cell in the z-direction, whereby white corresponds to 0 and black corresponds to 10.6 mD. The inter-cluster flow impediment data is also outputted.

In addition to the cluster number assigned to the grid cell and one effective permeability number for each of the three directions, the grid property data for each grid cell may further comprise other useful data including for example a grid cell cluster size consisting of the number of grid cells having the same cluster number as the cluster number that has been assigned to the grid cell. This way an ordering of the grid cell clusters by grid cell cluster size can be readily applied. The grid property data for each grid cell may further comprise the number of fractures in the grid cell that belong to the fracture cluster that has the unique fracture cluster number that uniquely maps to the unique grid cell cluster number.

In addition to the table containing grid property data and the inter-cluster flow impediment data, the method may also output cluster statistical data. Such cluster statistical data may include one or more of the group consisting of: number of cell clusters present in the simulation grid and a percentage of grid cells that form part of a cell cluster.

FIG. 5 illustrates the benefits of the proposed novel upscaling method for correctly creating a simulation grid with effective properties that correctly reflects the fracture connectivity of the DFN model. Parts a to c of FIG. 5 schematically show connectivity of grid cells in the simulation grid after upscaling of the DFN model of FIG. 1 using (a) Oda's method, (b) the flow-based method, and (c) the presently proposed upscaling method. Distinct grid cell clusters have been numbered by grey tones. Parts a and b are comparative examples of simulation grids obtained by directly upscaling the DFN model of FIG. 1; part c illustrates the proposed novel upscaling method. All parts of FIG. 5 further show the locations of three wells: first well 10, second well 20, and third well 30 into the corresponding hydrocarbon bearing reservoir. The first well 10 and the second well 20 both communicate through a single fracture cluster, whereas the third well 30 communicates with a different fracture cluster. In the DFN model, and possibly in the real hydrocarbon bearing reservoir formation, the third well 30 is therefore not connected with the first and second wells 10,20 via an percolating fracture network. It is critical for making correct field development decisions to take into account whether two wells are connected though a continuous (uninterrupted) network of fractures or not, as this will have a profound impact on the outcome of dynamic flow simulations.

Figure 5A:
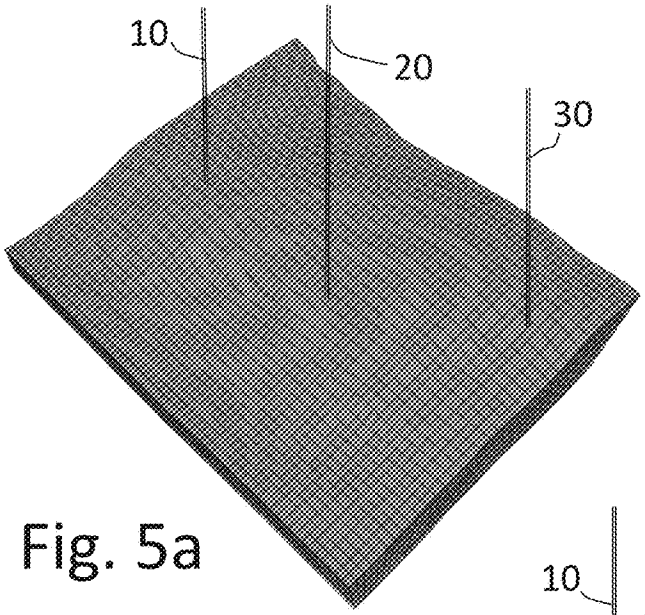
FIG. 5*a* schematically shows a comparative example showing grid cell clusters after applying Oda's method directly to the DFN model of FIG. 1.

In the example of the use of Oda's method, as illustrated in FIG. 5*a*, all grid cells in the upscaled simulation grid are connected and thus form one large grid cell cluster. When making dynamic flow simulations based on this simulation grid, the three wells 10, 20, and 30 are all connected. This is not conform the DFN model realization, and possibly not with the real hydrocarbon bearing reservoir, as the DFN model contains fracture clusters as shown in FIG. 2 and thus any dynamic simulation done using this simulation grid will be based on erroneous well interconnectivity premises.

Figure 5B:
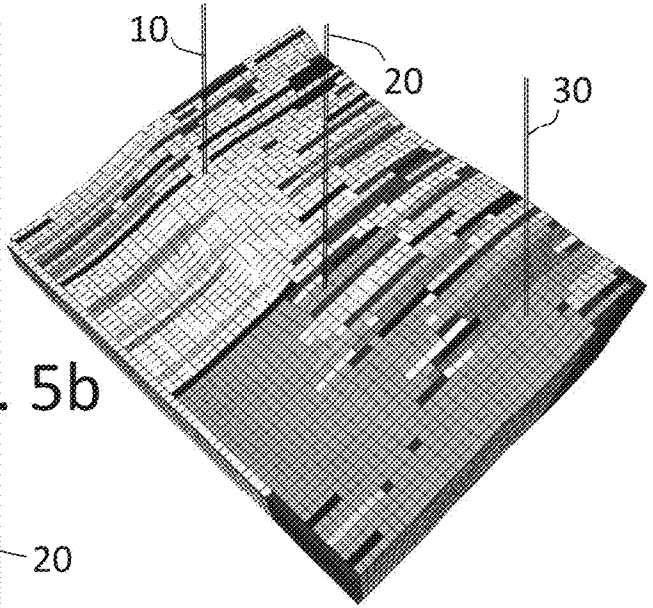
FIG. 5*b* schematically shows a comparative example showing grid cell clusters after applying the flow-based method directly to the DFN model of FIG. 1.

FIG. 5*b* shows that after applying the flow-based method a number of grid cell clusters have emerged. However, these grid cell clusters do not properly reflect the fracture clusters of FIG. 2. In this case, the first well 10 and the second well 20 are not connected because they communicate with different grid cell clusters. The second well 20 and the third well 30 are connected according to this upscaled simulation grid. Thus flow simulations based on this upscaled simulation grid are based on an incorrect well interconnectivity.

In conclusion as demonstrated by FIGS. 5*a* and 5*b*, the upscaling with Oda's method and the flow-based method fail to preserve the fracture clustering which is a critical characteristic in the DFN model on a full-field scale. A simulation grid that does not correctly preserve which grid cells are connected with each other by a continuous fracture network, and which grid cells are not, will yield profoundly misleading dynamic flow simulation results, which in turn impacts e.g. water breakthrough time predictions.

Figure 5C:
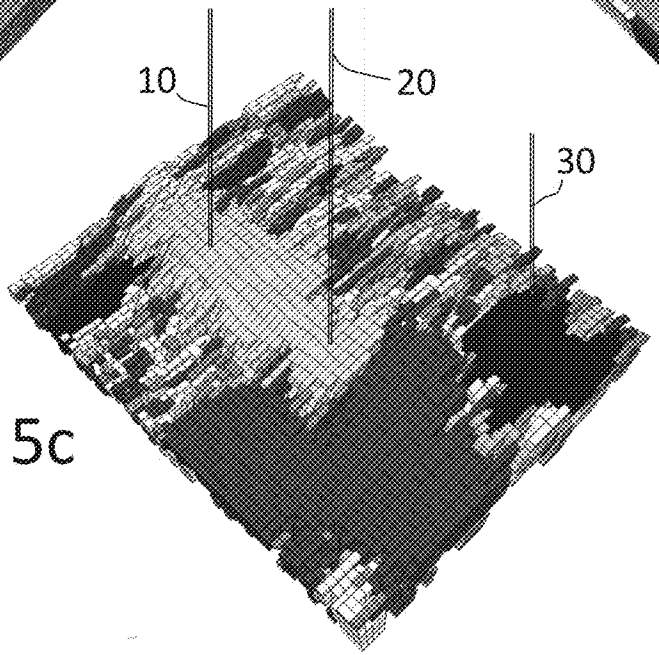
FIG. 5*c* schematically shows the three dimensional simulation grid of FIG. 3 after assigning grid cell cluster numbers to each grid cell in the simulation grid.

FIG. 5*c* schematically shows the three dimensional simulation grid of FIG. 3 after assigning grid cell cluster numbers to each grid cell in the simulation grid derived from fracture clusters in the DFN model. This is the only simulation grid that correctly reflects the interconnectivity between the wells 10, 20, and 30. Thus the proposed novel upscaling method gives information such as the number of wells in communication via fractures or the existence of a connected flow pathway via fractures into an aquifer.

The dynamic simulations using simulation grids that have been generated using the presently proposed novel upscaling method can be used to benchmark against the real hydrocarbon bearing reservoir formation in the subsurface. By comparing simulation results with real flow data one of the DFN models out of a number of initial DFN models can be selected as the one that best describes the reality.

The person skilled in the art will understand that the present invention can be carried out in many various ways without departing from the scope of the appended claims.

What is claimed is:

1. Method of upscaling a discrete fracture network model, comprising:

providing a discrete fracture network model of a subsurface fractured hydrocarbon bearing reservoir formation, said discrete fracture network model comprising a plurality of fractures;

grouping all fractures of the plurality of fractures into fracture clusters, whereby all fractures that are physically connected with each other by intersection, either directly or indirectly via a number of other physically connected fractures, exclusively belong to one fracture cluster such that no fracture within one fracture cluster is physically connected with any fracture of any of the other fracture clusters;

assigning a unique fracture cluster number to each of the fracture clusters;

overlaying a three dimensional simulation grid over the discrete fracture network model, consisting of a three dimensional array of grid cells in three directions;

attributing a grid cell cluster number to each grid cell in the simulation grid, which grid cell cluster number uniquely maps to the unique fracture cluster number of exclusively one fracture cluster that intersects with the grid cell;

computing an effective permeability for each grid cell and for each of the three directions using the fractures that are inside the grid cell and that form part of the fracture cluster that has the fracture cluster number to which the grid cell cluster number of the grid cell is uniquely mapped, whereby ignoring other fractures that are inside the grid cell but that form part of a fracture cluster having a fracture cluster number that does not map to the grid cell cluster number of the grid cell; and assigning inter-cluster flow impediment data to selected grid cells reflecting flow impediment bathers between neighboring grid cell clusters;

outputting a table containing grid property data for all grid cells, wherein the grid property data for each grid cell comprises the cluster number assigned to the grid cell, and one effective permeability number for each of the three directions; and outputting inter-cluster flow impediment data.

2. The method of claim 1, wherein when more than one fracture cluster intersect with the grid cell the grid cell cluster number attributed to the grid cell maps to the unique fracture cluster number of the one of the fracture clusters that intersects with the grid cell and that intersects with the highest number of other grid cells compared to how many other grid cells intersect with the other fracture clusters that intersect the grid cell.

3. The method of claim 1, wherein the grid property data for each grid cell further comprises a grid cell cluster size consisting of the number of grid cells having the same cluster number as the cluster number that has been assigned to the grid cell.

4. The method of claim 1, wherein the grid property data for each grid cell further comprises the number of fractures in the grid cell that belong to the fracture cluster that has the unique fracture cluster number that uniquely maps to the unique grid cell cluster number.

5. The method of claim 1, wherein further outputting cluster statistical data including one or more of the group consisting of: number of cell clusters present in the simulation grid and a percentage of grid cells that form part of a cell cluster.

6. The method of claim 1, wherein assigning of inter-cluster flow impediment data consists of imposing a lower effective permeability in at least one of the three directions on grid cells that are adjacent to grid cells that do not have the same grid cell cluster number than the computed effective permeability using the fractures that are inside the grid cell and that form part of the fracture cluster that has the same fracture cluster number as the grid cell cluster number of the grid cell whereby ignoring other fractures that are inside the grid cell but that form part of a fracture cluster having a fracture cluster number that is different from the grid cell cluster number of the grid cell.

7. The method of claim 6, wherein the lower effective permeability is imposed on the grid cell that separates two neighboring grid cell clusters and that belongs to the grid cell cluster that contains the fewer grid cells of the two neighboring grid cell clusters.

8. The method of claim 1, wherein assigning of inter-cluster flow impediment data consists of imposing an inter-cell transmissibility barrier between adjacent grid cells that do not have the same grid cell cluster number.

9. The method of claim 1, wherein the effective permeability for each grid cell is computed using an analytical expression of the effective permeability tensor using Oda's method wherein adding weighted fracture permeabilities in each of the three directions.

10. The method of claim 1, further comprising creating a field development plan comprising using the table containing the grid property data for all grid cells and the inter-cluster flow impediment data, and subsequently executing the field development plan employing a well that connects into the subsurface fractured hydrocarbon bearing reservoir formation.

11. A computer readable medium having stored on it a set of computer instructions that when loaded in a computer is capable of carrying out steps comprising:

receiving a discrete fracture network model of a subsurface fractured hydrocarbon bearing reservoir formation, said discrete fracture network model comprising a plurality of fractures as input;

grouping all fractures of the plurality of fractures into fracture clusters, whereby all fractures that are physically connected with each other by intersection, either directly or indirectly via a number of other physically connected fractures, exclusively belong to one fracture cluster such that no fracture within one fracture cluster is physically connected with any fracture of any of the other fracture clusters;

assigning a unique fracture cluster number to each of the fracture clusters;

overlaying a three dimensional simulation grid over the discrete fracture network model, consisting of a three dimensional array of grid cells in three directions;

attributing a grid cell cluster number to each grid cell in the simulation grid, which grid cell cluster number uniquely maps to the unique fracture cluster number of exclusively one fracture cluster that intersects with the grid cell;

computing an effective permeability for each grid cell and for each of the three directions using the fractures that are inside the grid cell and that form part of the fracture cluster that has the fracture cluster number to which the grid cell cluster number of the grid cell is uniquely mapped, whereby ignoring other fractures that are inside the grid cell but that form part of a fracture cluster having a fracture cluster number that does not map to the grid cell cluster number of the grid cell; and assigning inter-cluster flow impediment data to selected grid cells reflecting flow impediment barriers between neighboring grid cell clusters;

outputting a table containing grid property data for all grid cells, wherein the grid property data for each grid cell comprises the cluster number assigned to the grid cell, and one effective permeability number for each of the three directions; and outputting inter-cluster flow impediment data.

12. A computer system programmed to carry out steps comprising:

receiving a discrete fracture network model of a subsurface fractured hydrocarbon bearing reservoir formation, said discrete fracture network model comprising a plurality of fractures as input;

grouping all fractures of the plurality of fractures into fracture clusters, whereby all fractures that are physically connected with each other by intersection, either directly or indirectly via a number of other physically connected fractures, exclusively belong to one fracture cluster such that no fracture within one fracture cluster is physically connected with any fracture of any of the other fracture clusters;

assigning a unique fracture cluster number to each of the fracture clusters;

overlaying a three dimensional simulation grid over the discrete fracture network model, consisting of a three dimensional array of grid cells in three directions;

attributing a grid cell cluster number to each grid cell in the simulation grid, which grid cell cluster number uniquely maps to the unique fracture cluster number of exclusively one fracture cluster that intersects with the grid cell;

computing an effective permeability for each grid cell and for each of the three directions using the fractures that are inside the grid cell and that form part of the fracture cluster that has the fracture cluster number to which the grid cell cluster number of the grid cell is uniquely mapped, whereby ignoring other fractures that are inside the grid cell but that form part of a fracture cluster having a fracture cluster number that does not map to the grid cell cluster number of the grid cell; and assigning inter-cluster flow impediment data to selected grid cells reflecting flow impediment bathers between neighboring grid cell clusters;

outputting a table containing grid property data for all grid cells, wherein the grid property data for each grid cell comprises the cluster number assigned to the grid cell, and one effective permeability number for each of the three directions; and outputting inter-cluster flow impediment data.

* * * * *